US005951227A

United States Patent [19]

Calkins et al.

[11] Patent Number: 5,951,227

[45] Date of Patent: Sep. 14, 1999

[54] DEEP WATER LOWERING APPARATUS

[75] Inventors: Dennis Earl Calkins, Katy, Tex.; Afif Michel Labaki, New Orleans, La.; James Joseph Toups, Houma, La.; Kevin Patrick Zaeringer, Metairie, La.

[73] Assignee: J. Ray McDermott, S.A., New Orleans, La.

[21] Appl. No.: 09/123,922

[22] Filed: Jul. 28, 1998

[51] Int. Cl.[6] ..... B63B 27/08

[52] U.S. Cl. ..... 414/141.7; 114/268; 212/307; 254/285; 254/337; 294/81.1

[58] Field of Search ..... 212/307, 311; 254/285, 337, 900; 414/141.7, 142.8; 405/224; 114/268, 51; 294/81.1

[56] References Cited

U.S. PATENT DOCUMENTS

| | | | |
|---|---|---|---|
| 3,929,235 | 12/1975 | Howard et al. | 114/268 |
| 4,073,476 | 2/1978 | Frank | 254/285 |
| 4,537,333 | 8/1985 | Hampton | 405/224 |
| 4,838,522 | 6/1989 | Calkins | 254/337 |
| 4,919,393 | 4/1990 | Calkins | 254/337 |
| 5,114,026 | 5/1992 | Van Ketel Hendrik | 254/900 |
| 5,579,931 | 12/1996 | Zuehlke et al. | 212/281 |

FOREIGN PATENT DOCUMENTS

| | | | |
|---|---|---|---|
| 872443 | 10/1981 | U.S.S.R. | 254/285 |

*Primary Examiner*—Thomas J. Brahan
*Attorney, Agent, or Firm*—Robert J. Edwards; D. Neil LaHaye

[57] ABSTRACT

A deep water lowering apparatus that utilizes dual davit structures mounted on a barge. Each davit structure has a pulling wire rope line spooled on a storage winch. Each pulling line is reeved onto a traction winch and through upper and lower sheaves on the davit structure. Corresponding ends of each pulling line are connected together on an equalizer beam. An adaptor box is suspended from a spreader bar provided with a dog leg center portion for effecting the load transfer from the crane. The lowering tool that supports the load is directly received in the adaptor box and transfers the load to the lowering apparatus without the need for rigging work.

4 Claims, 15 Drawing Sheets

DEEP WATER LOWERING APPARATUS

BACKGROUND OF THE INVENTION

1. Field of the Invention

The invention is generally related to the installation of underwater structural components for offshore production systems and more particularly to the installation of such components in deep water.

2. General Background

The installation of underwater structural components for offshore production systems, such as templates, piles, conductors, and tower bottom sections, has been accomplished using derrick barge cranes. The template is a tubular steel framework that serves as a piling and conductor guide and equipment platform that extends from the sea floor up to approximately thirty feet above the mudline. The pilings consist of large steel tubes which secure the template or the tower bottom section to the sea floor and penetrate the soil to as much as six hundred feet. Conductors are steel pipes which are driven into the soil through guides connected to the template that are used for drilling wells. The tower bottom section is the lower portion of a large offshore platform.

The most common means of installing underwater templates, piles, and conductors is the use of cranes mounted on derrick barges. Cranes have capacity limitations for underwater blocks and most derrick barge cranes are not equipped with underwater blocks. An advantage of the use of a crane is that it does not require a load transfer from the crane to another system. A disadvantage of using a crane is the restriction of the offshore underwater installation to relatively light loads and shallow water due to the capacity limitation of underwater blocks. Another disadvantage of using a crane is that it ties up the crane from doing other work during lowering operations and limits the capability of the crane to provide assistance during emergencies that may arise.

A second installation means is a pulling system mechanism with grippers and a traveling block sheave assembly. A general advantage of this system is that it can handle a heavier load than a crane, depending upon the size of the pulling system and the pulling line. A disadvantage of this system is that it requires load transfer from the crane to the pulling system and sheave system. Another disadvantage is that it ties up the crane from doing other work during lowering operations and restricts the cranes from the capability of any assistance during emergencies.

A third system is a multiple hoist system that provides the advantages of freeing the barge crane to do other work and increases the offshore underwater installation to heavier loads and in deeper water. Disadvantages include: Load transfer is required from the crane to the multiple hoist system. One operator is required for each winch. The hoists are operated at different and low speeds. There is no master control console to synchronize all hoist drums. There is no equalizer beam to control the differential load and elongation between the wire ropes and the variable hoist speed. Separate offshore lifts are required for each component of the system and the system requires offshore assembly.

It can be seen that the current state of the art does not adequately address the needs encountered in lowering components for offshore production systems in deep water.

SUMMARY OF THE INVENTION

The invention addresses the above needs. What is provided is a deep water lowering apparatus that utilizes dual davit structures mounted on a barge. Each davit structure has a pulling wire rope line spooled on a storage winch. Each pulling line is reeved onto a traction winch and through upper and lower sheaves on the davit structure. The lower sheaves are connected to a spreader bar and adaptor box, providing a single lowering point. Corresponding ends of each pulling line are connected together on an equalizer beam. The adaptor box is suspended from the spreader bar provided with a dog leg center portion for effecting the load transfer from the crane. The lowering tool that supports the load is directly received in the adaptor box and transfers the load to the lowering apparatus without the need for rigging work.

BRIEF DESCRIPTION OF THE DRAWINGS

For a further understanding of the nature and objects of the present invention reference should be made to the following description, taken in conjunction with the accompanying drawings in which like parts are given like reference numerals, and wherein.

DETAILED DESCRIPTION OF THE PREFERRED EMBODIMENT

Figure 1:
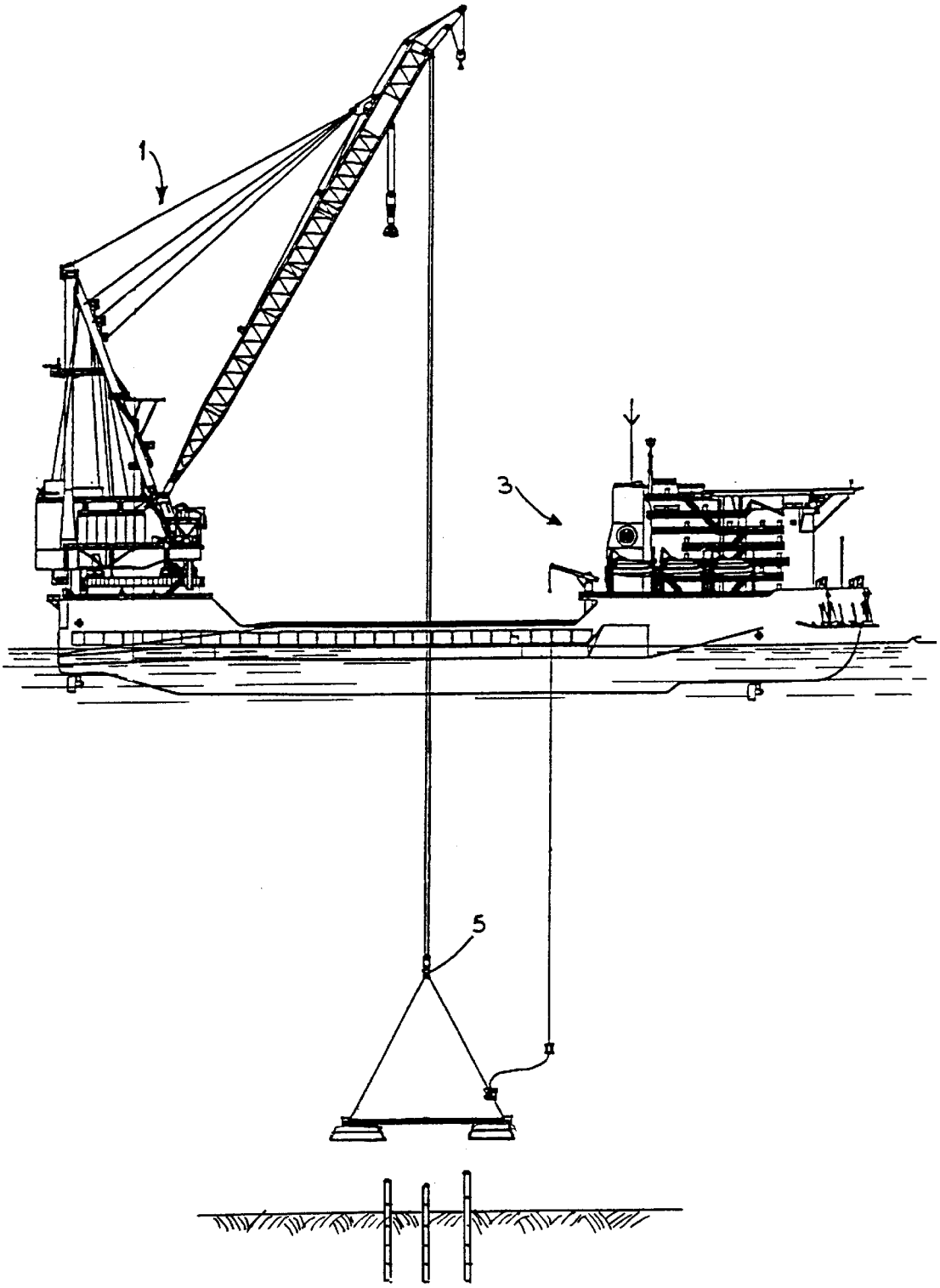
FIG. 1 PRIOR ART
FIG. 1 illustrates the prior art use of a crane on a barge.

FIG. 1 illustrates the prior art use of a crane 1 mounted on a derrick barge 3. Cranes typically have limitations for the underwater block 5.

Figure 2:
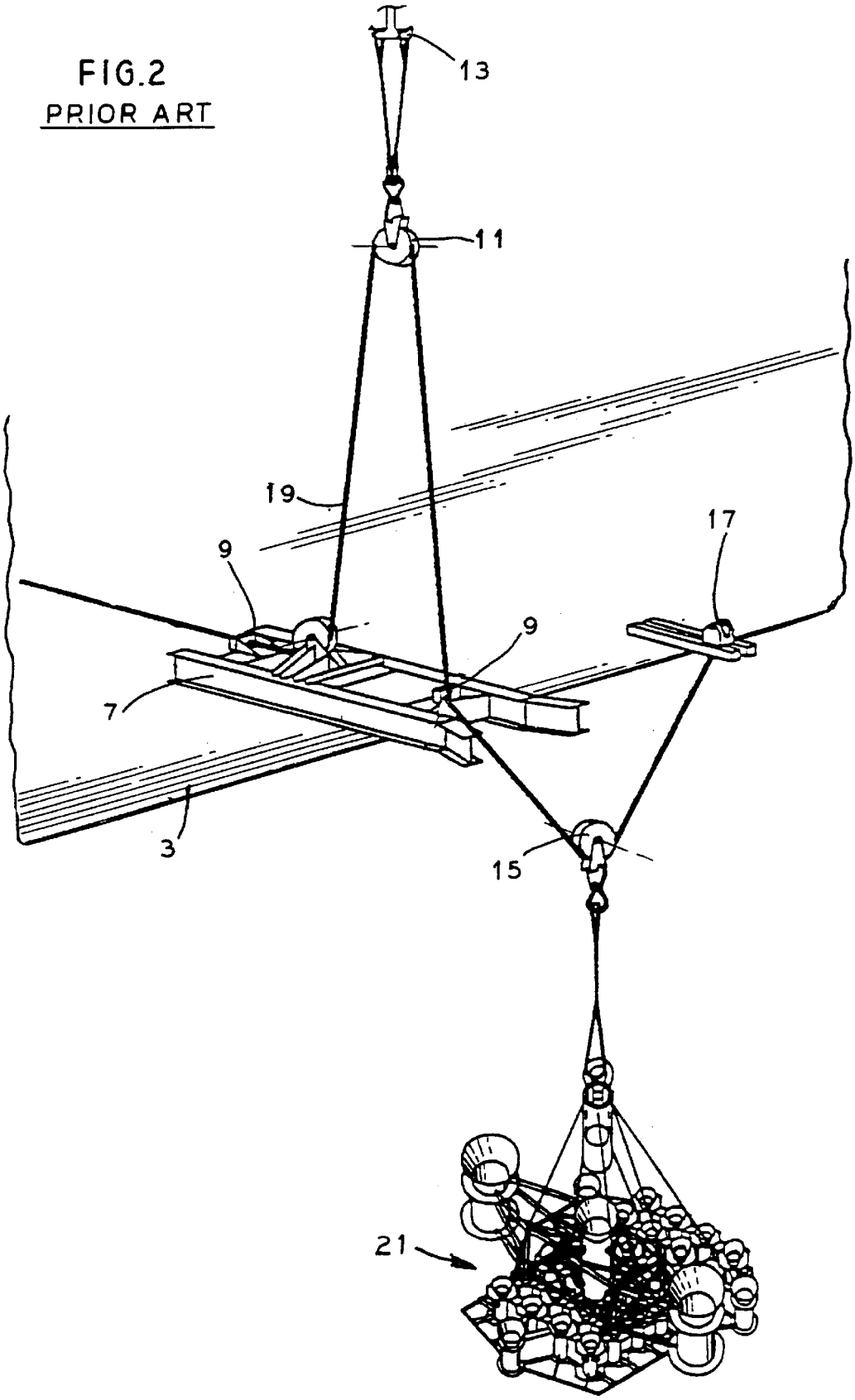
FIG.2 PRIOR ART
FIG. 2 illustrates the prior art use of a pulling system on a barge.

FIG. 2 illustrates the prior art use of a pulling system mechanism 7 mounted on the barge 3. Grippers 9 on the pulling mechanism 7, an upper traveling block sheave 11 on the crane block 13, a lower traveling block sheave 15, and a dead end support 17 are used to control the pulling line 19 and the load 21, which is illustrated as a template.

Figure 3:
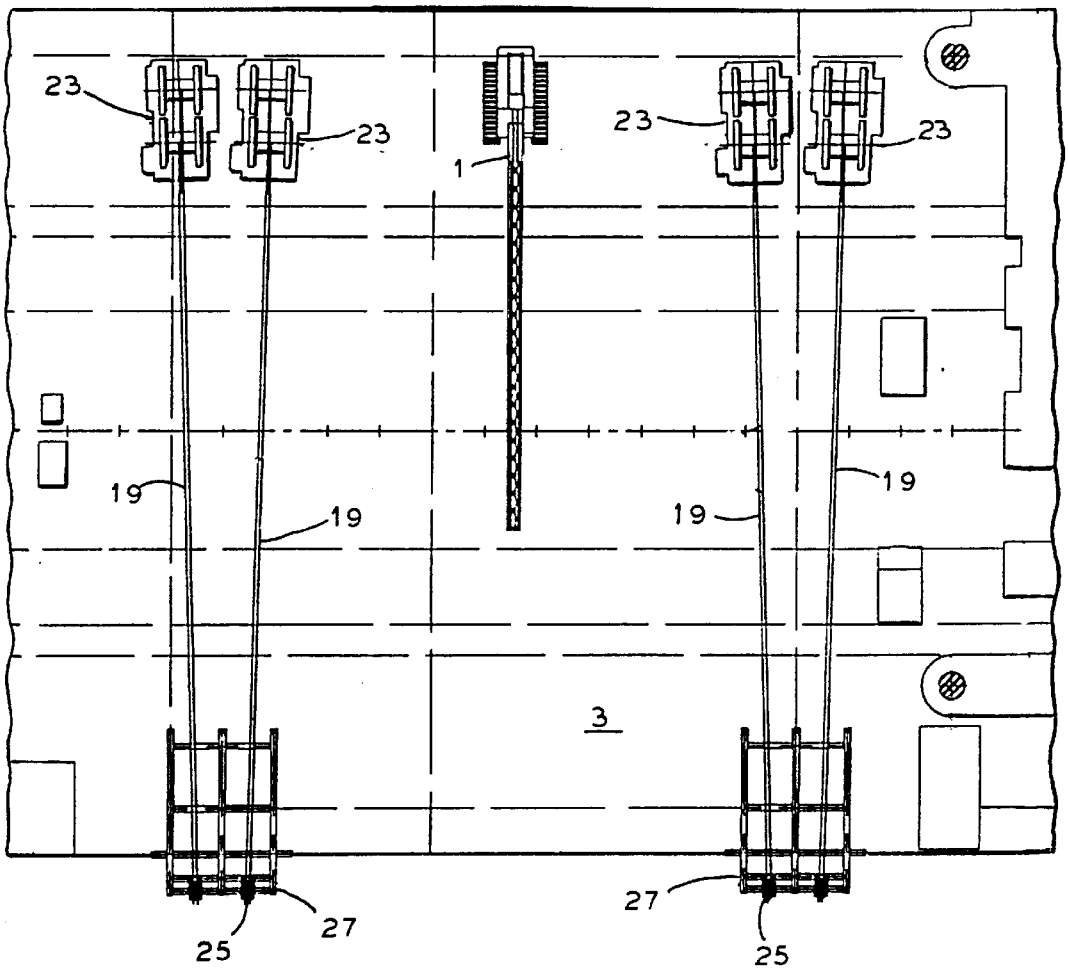
FIG. 3 PRIOR ART
FIG. 3 illustrates the prior art use of a multiple hoist system on a barge.

FIG. 3 illustrates the prior art use of a multiple hoist system mounted on the barge 3 that uses two double hoist drums 23. Each drum directs its pulling lines 19 to a sheave assembly mounted on a tower 27.

Figure 4:
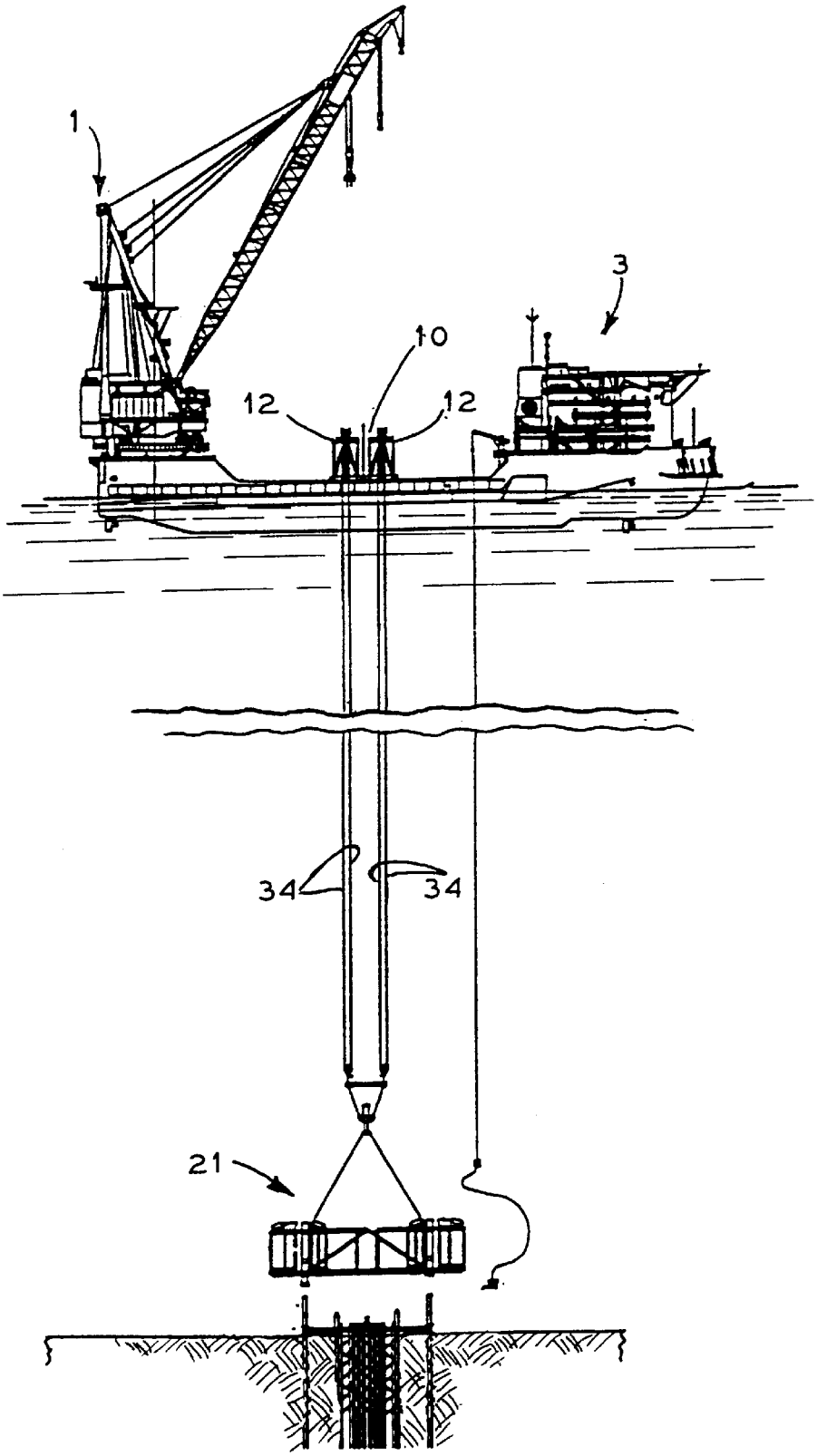
FIG. 4 is a side view that generally illustrates the use of the invention lowering a load.
Figure 6:
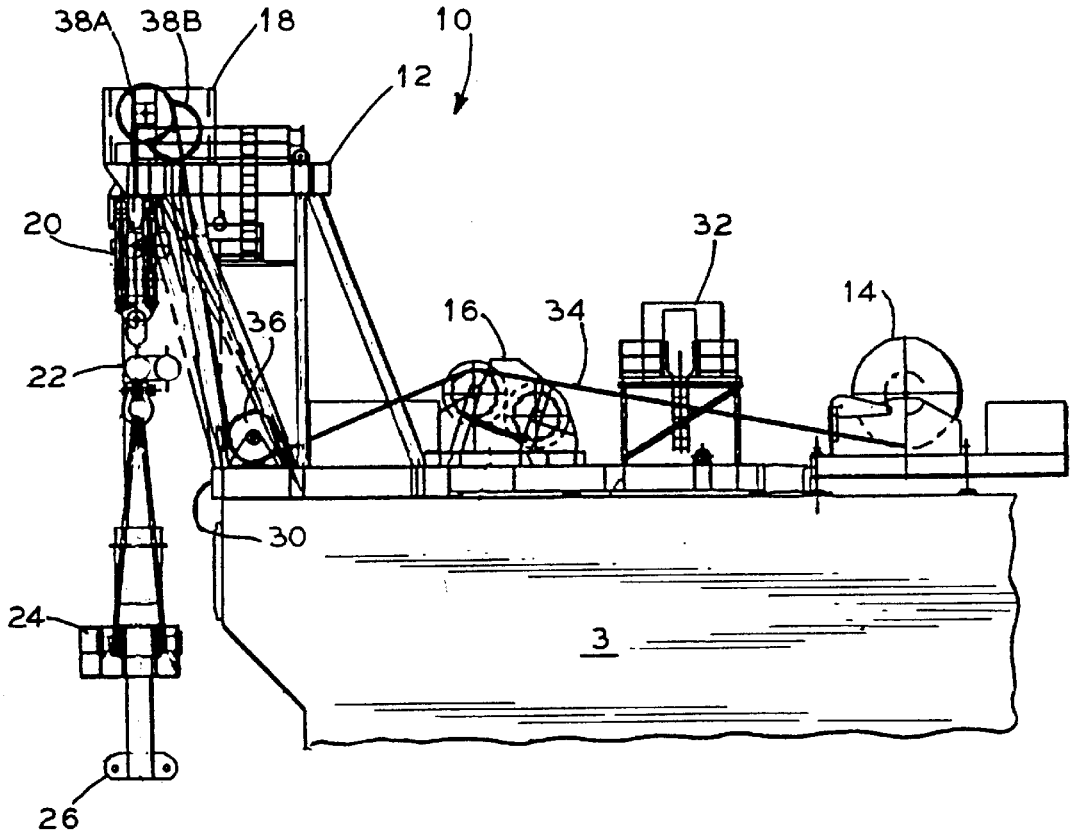
FIG. 6 is a side view of the invention.
Figure 7:
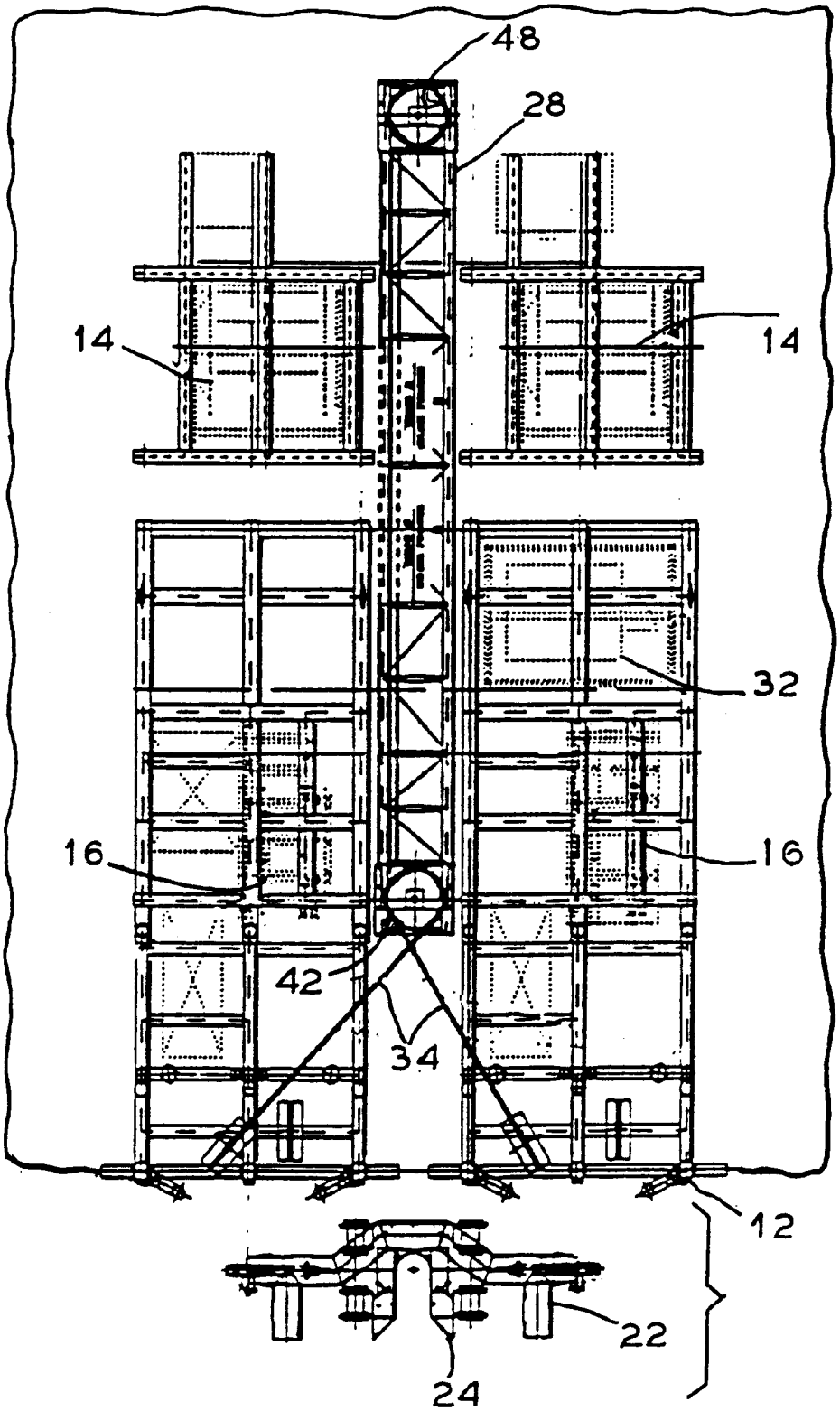
FIG. 7 is a plan view of the invention.

As seen in FIG. 4 and 6, the invention is generally indicated by the numeral 10. Deep water lowering apparatus 10 is generally comprised of two davits 12, two storage winches 14, two traction winches 16, two sets of upper and lower sheave blocks 18 and 20, a spreader bar 22, an adaptor box 24, a lowering tool 26, and an equalizer beam 28. Where necessary for ease of reference, only one of the dual items of the invention will be referred to and described.

The invention is mounted on skids 30 received on the barge 3, which results in the invention being portable. This allows the apparatus to be moved from vessel to vessel as needed. One davit 12, storage winch 14, traction winch 16, and set of upper and lower sheave blocks 18 are mounted on a skid 30 so as to be in alignment with each other. The second davit 12, storage winch 14, traction winch 16, and set of upper and lower sheave blocks 18, 20 are also mounted on a skid 30 so as to be in alignment with each other. The two sets of davits and associated equipment are mounted on the skids 30 so as to be spaced apart and parallel to each other. The skids 30 are positioned such that the davits are at the edge of the barge 3. Operations are controlled from operator cab 32 mounted between the skids 30.

Figure 5:
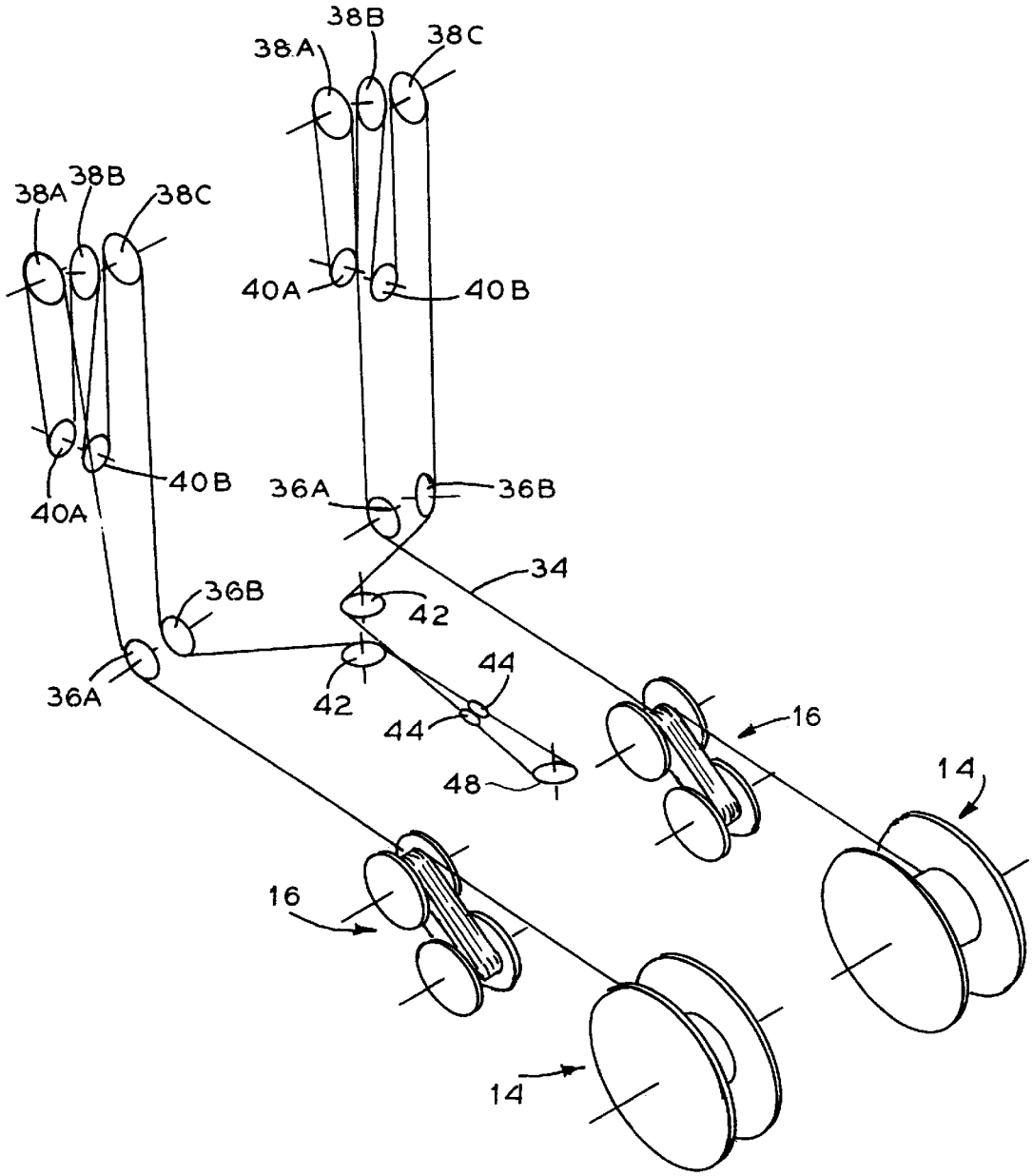
FIG. 5 is a schematic illustration of the lowering mechanism of the invention.

Pulling line 34, preferably wire rope, is stored on each storage winch 14. As best seen in the schematic illustration of FIG. 5, the pulling line 34 from the storage winch is reeved around both drums on the traction winch 16, under fixed sheave 36A, over the sheave 38A on upper sheave block 18, under the sheave 40A on the lower sheave block 20, over the sheave 38B on the upper sheave block 18, under the sheave 40B on the lower sheave block 20, over the upper sheave 38C on the upper sheave block 18, under fixed sheave 36B, and around the dual vertically stacked sheaves 42 on one end of the equalizer beam 28. The ends of the pulling lines 34 from each storage winch 14 are indicated at numeral 44. A pendant line 46 has each end attached to the respective ends of the pulling lines 34 from each storage winch and is reeved around sheave 48 at the opposite end of the equalizer beam 28.

The pulling lines 34 are preferably a left lay cable on one storage winch and a right lay cable on the other storage winch. Using oppositely wound pulling lines blaances the wire torsion in each pulling wire. This prevents twisting of the load during lowering or lifting operations and also prevents twisting of the spreader bar and adaptor box (traveling assembly).

The arrangement of the pulling lines 34 and pendant line 46 around the sheaves on the equalizer beam acts to resist the natural torsion of the lines during operations that can result from variables such as unequal bearing friction or differing winch speeds.

Figure 8:
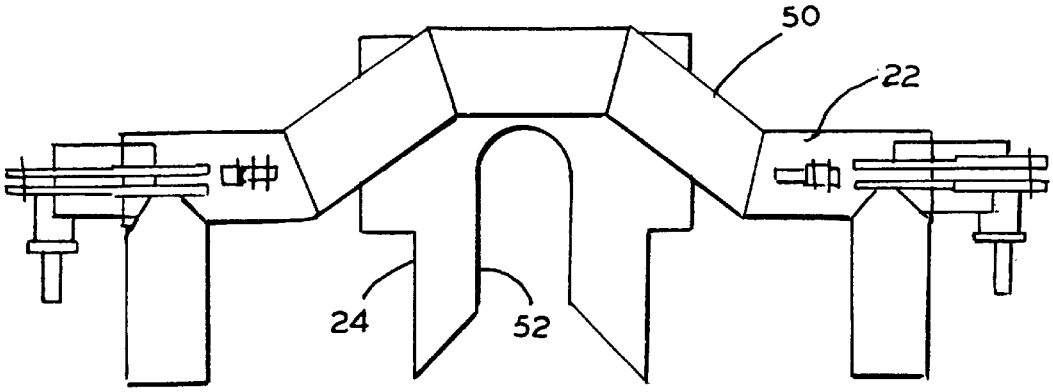
FIG. 8 is a plan view that illustrates the spreader bar and adaptor box of the invention.

FIG. 8 illustrates the spreader bar 22 and adaptor box 24. The spreader bar is used in a common manner to maintain spacing between at least two lifting lines. However, where a traditional spreader bar is straight, the spreader bar 22 of the invention is provided with a dog leg shaped center section 50.

It can also be seen in FIG. 8 that the adaptor box 24 is provided with a U-shaped opening 52, the U-shape being positioned in the horizontal plane and with the open end of the U facing the same direction as the open side of the dog leg section 50 in the spreader bar 22, away from the side of the barge 3. The purpose of the dog leg section 50 in the spreader bar 22 and U-shaped opening in the adaptor box 24 will be explained below.

Figure 9A:
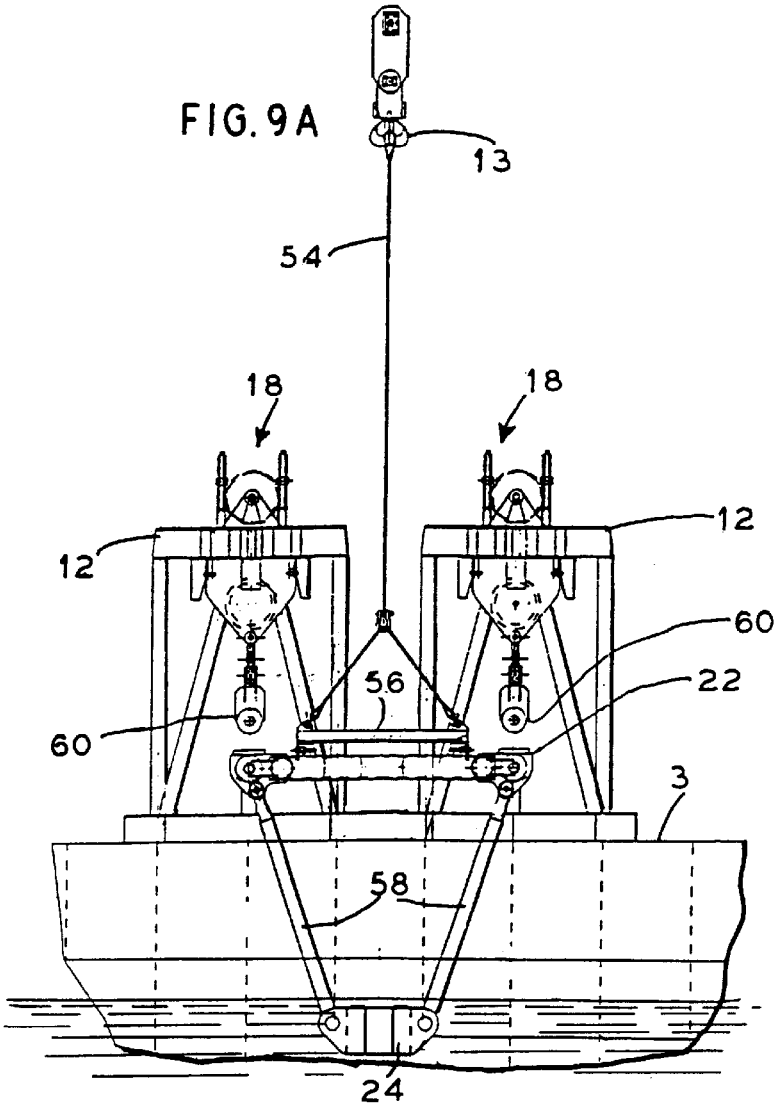
FIG. 9A and 9B illustrate the sequence of installing the spreader bar and adaptor box.
Figure 9B:
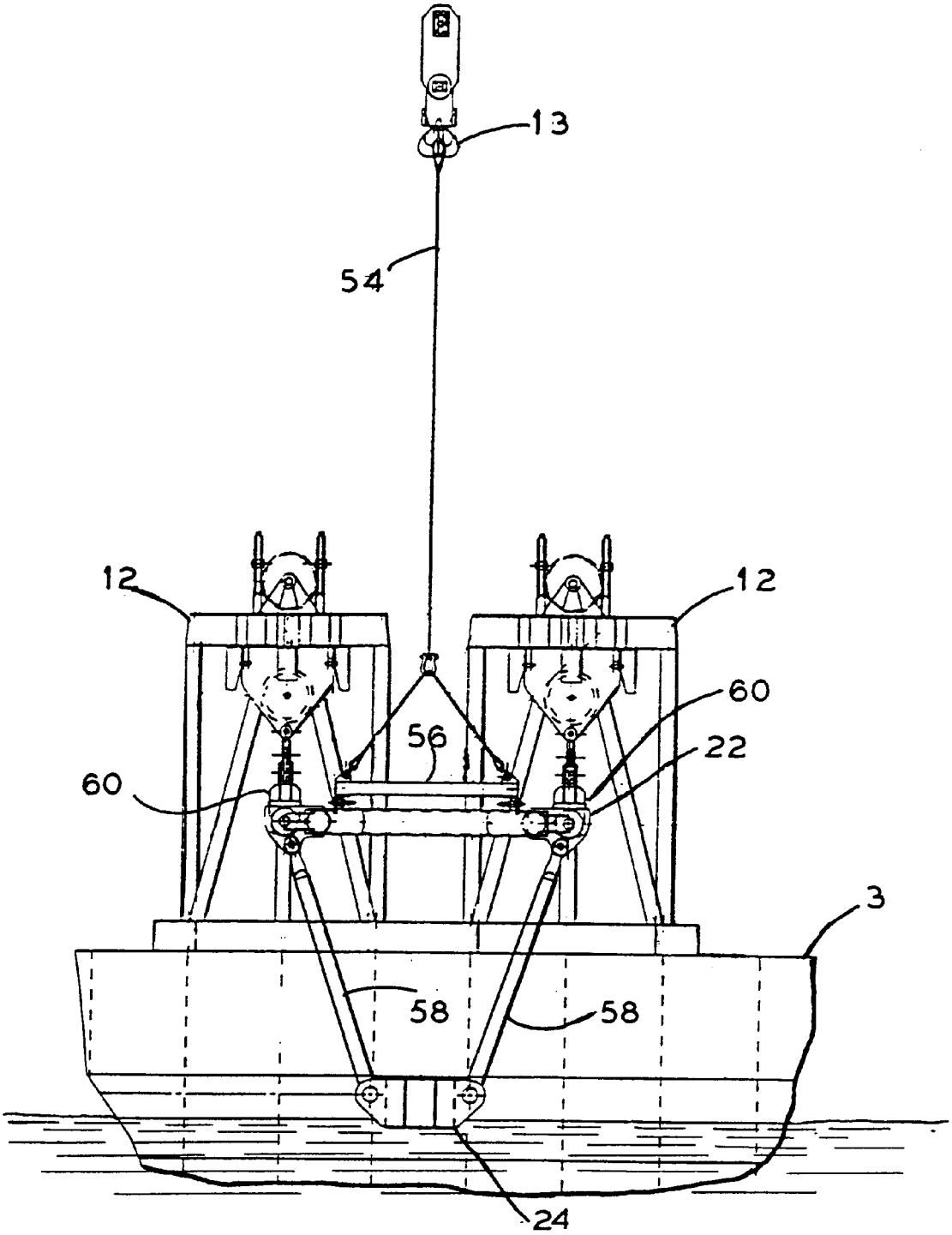

FIG. 9A and 9B illustrate the installation of the spreader bar 22 and adaptor box 24. Line 54 extends from the crane block 13 to a handling bar 56. Handling bar 56 is attached to the spreader bar 22. Adaptor box 24 is suspended from the spreader bar by means of slings 58. The ends of the spreader bar 22 are brought into alignment with each link plate 60 such that the spreader bar can be attached to the link plates 60 by any suitable means such as pinning, as seen in FIG. 9B. The apparatus is then ready for the load transfer of the structure to be and installed.

The operation of moving and transferring the load of the structure to be installed from the crane on the barge to the apparatus of the invention is illustrated in FIG. 10–12. Elements such as the davit have been omitted in these drawing Figures for ease of illustration.

Figure 10A:
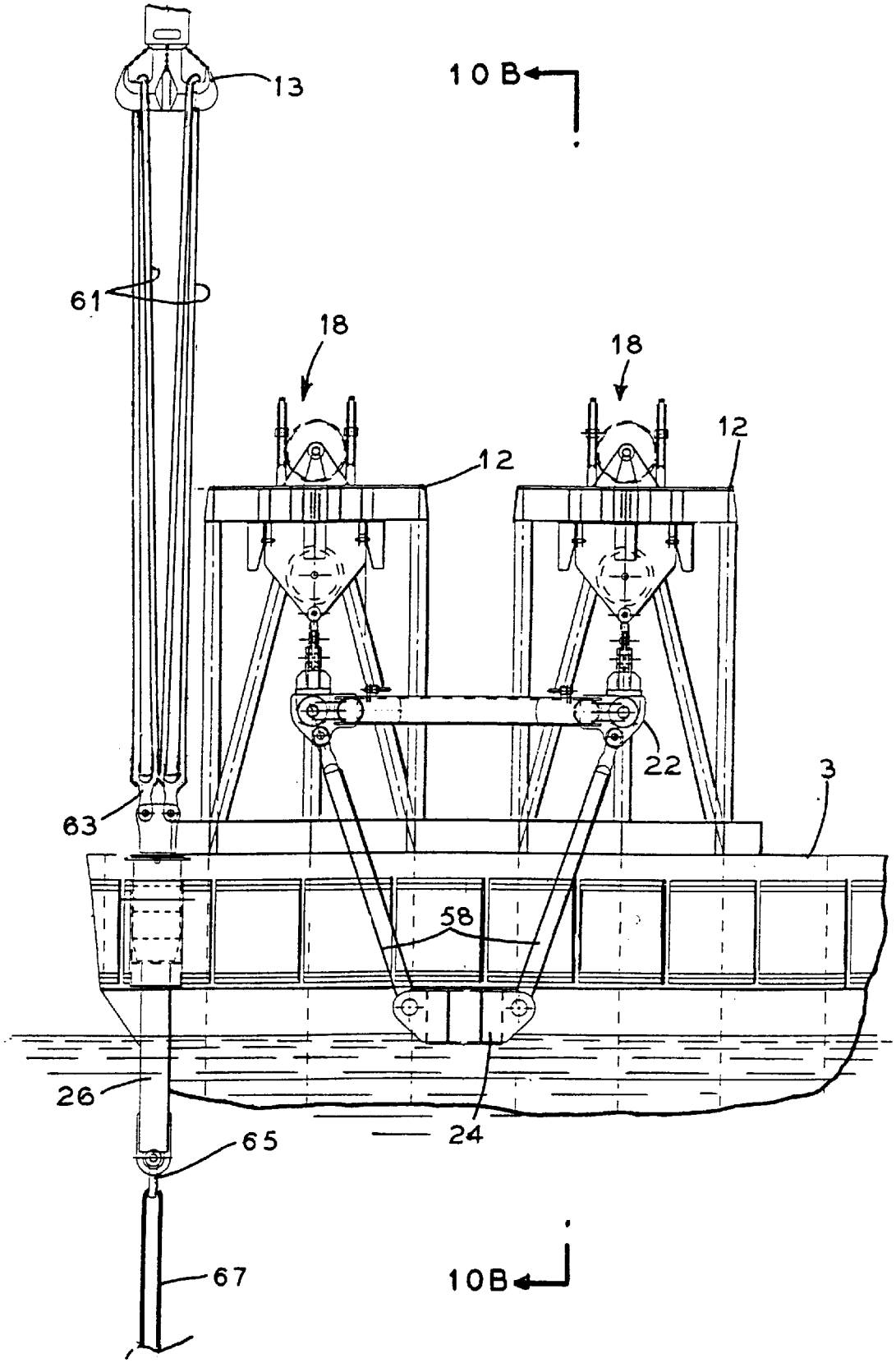
FIG. 10A illustrates the movement of the lowering tool of the invention, with the weight of the installation structure thereon, for transfer to the lowering portion of the invention.
Figure 10B:
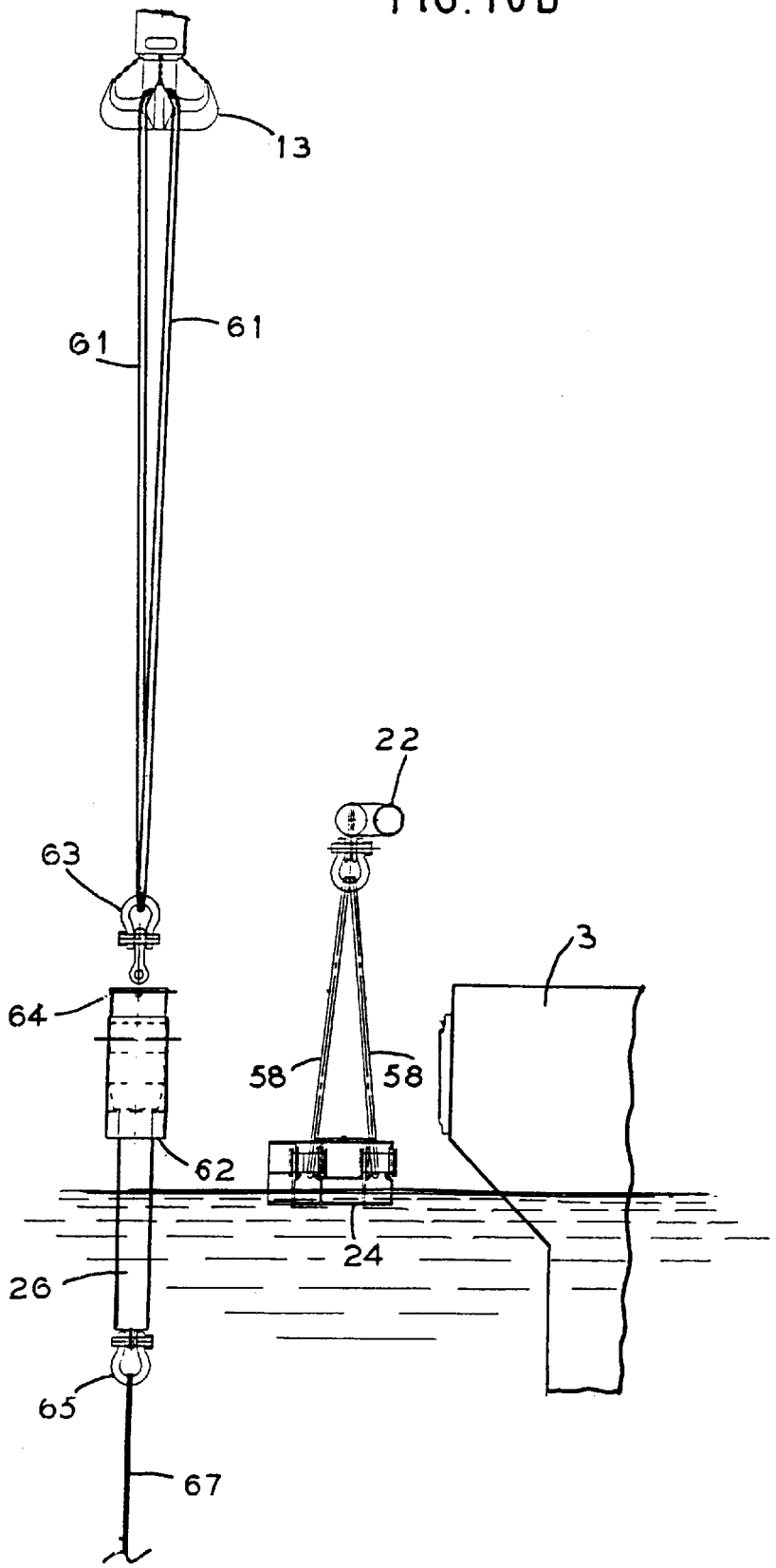
FIG. 10B is a view taken along lines 10B—10B in FIG. 10A.

FIG. 10A illustrates the movement of the lowering tool 26 and load toward the adaptor box 24. In this step, the load of the structure to be installed is borne completely by the crane 1 on the barge. Slings 61 are attached between the crane block 13 and one or more shackles 63 on the crane internal elevator 64, which is releasably attached to the lowering tool 26. Slings 67 are attached between one or more shackles 65, attached to the lower end of the lowering tool 26, and the load, not shown. FIG. 10B illustrates the alignment of the lowering tool 26 with the adaptor box.

Figure 11A:
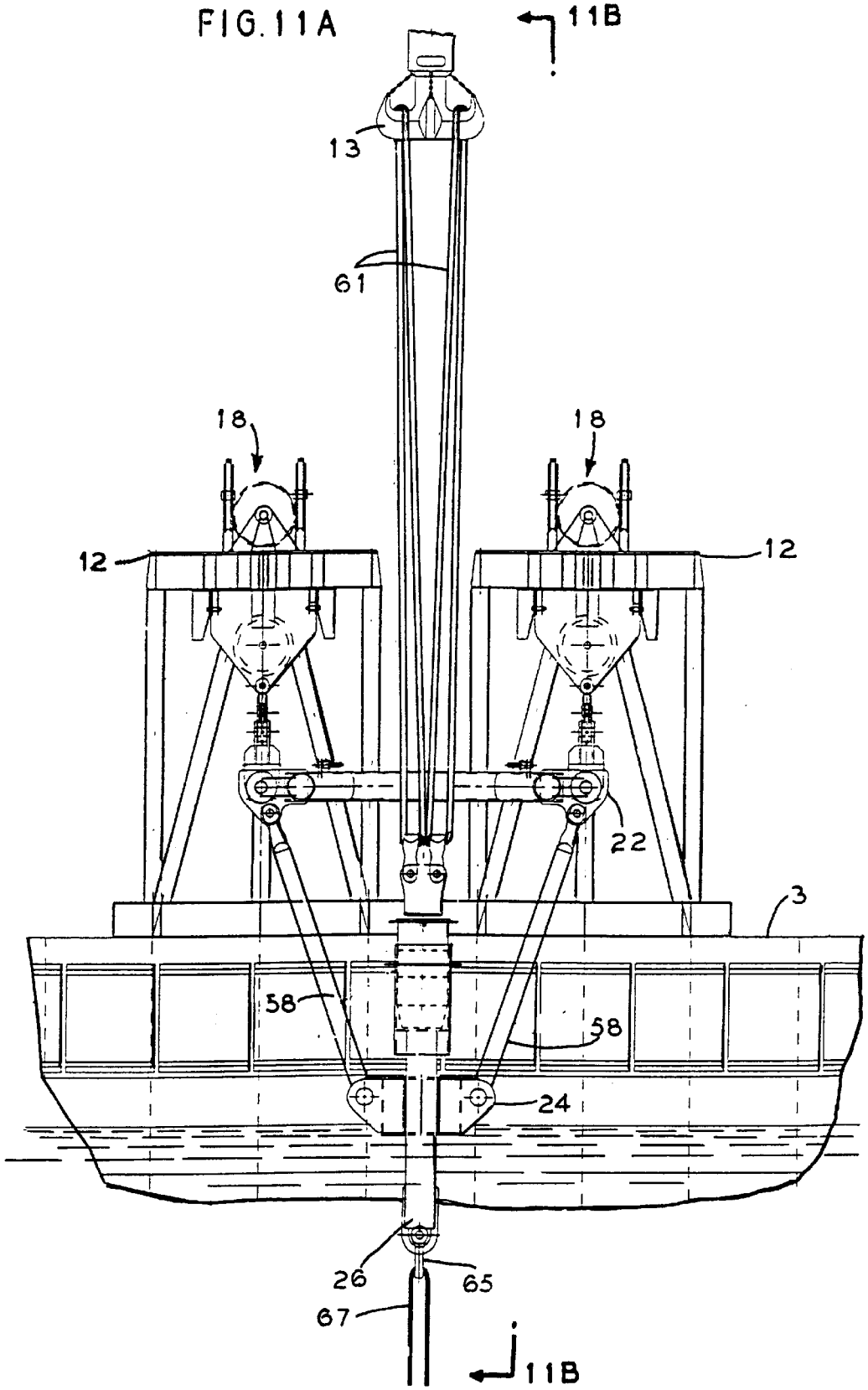
FIG. 11A illustrates the lowering tool of the invention being moved into the adaptor box of the invention.
Figure 11B:
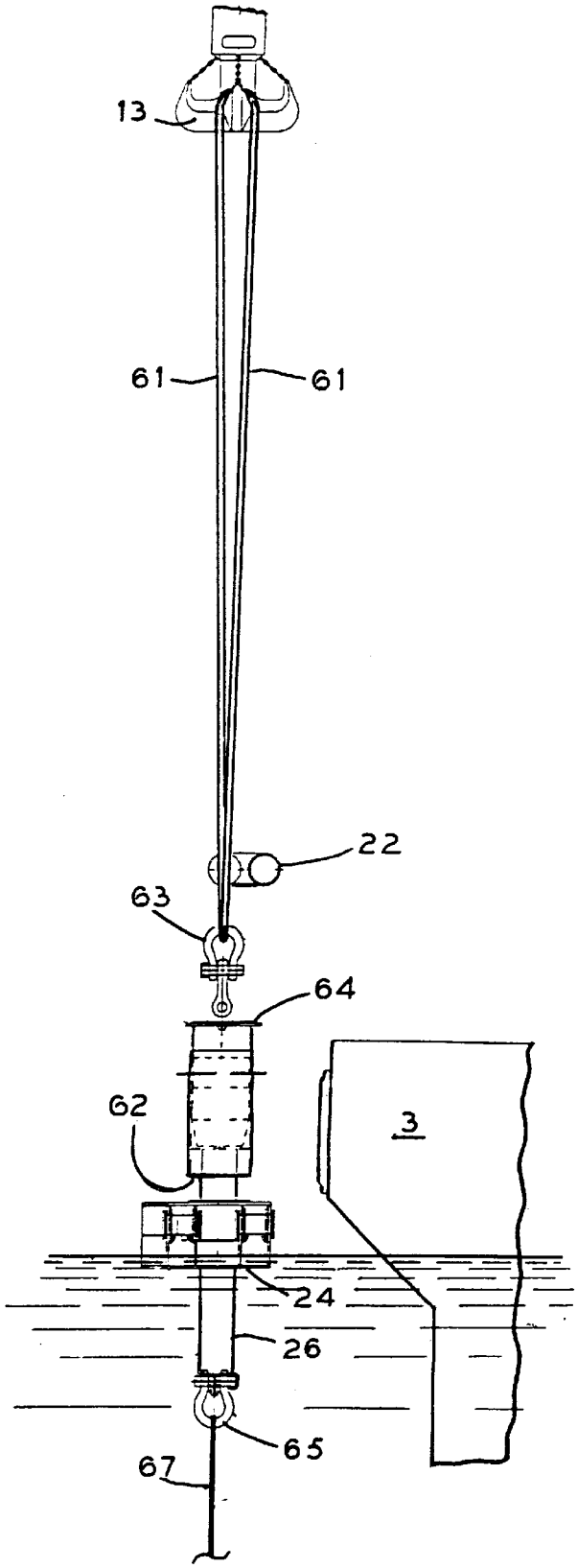
FIG. 11B is a view taken along lines 11B—11B in FIG. 11A.

FIG. 11A illustrates the lowering tool 26 being moved into the adaptor box 24. As best seen in FIG. 11B, the lowering tool 26 is sized to be received within the U-shaped opening of the adaptor box. The lowering tool 26 is also provided with a shoulder 62 that has a larger diameter than the U-shaped opening 52 in the adaptor box 24. After the lowering tool 26 is received in the U-shaped opening 52, the lowering tool 26 is lowered until the shoulder 62 is resting upon the upper portion of the adaptor box 24 and has transferred the weight of the load onto the adaptor box 24. This results in the load being directly transferred to the invention.

Figure 12A:
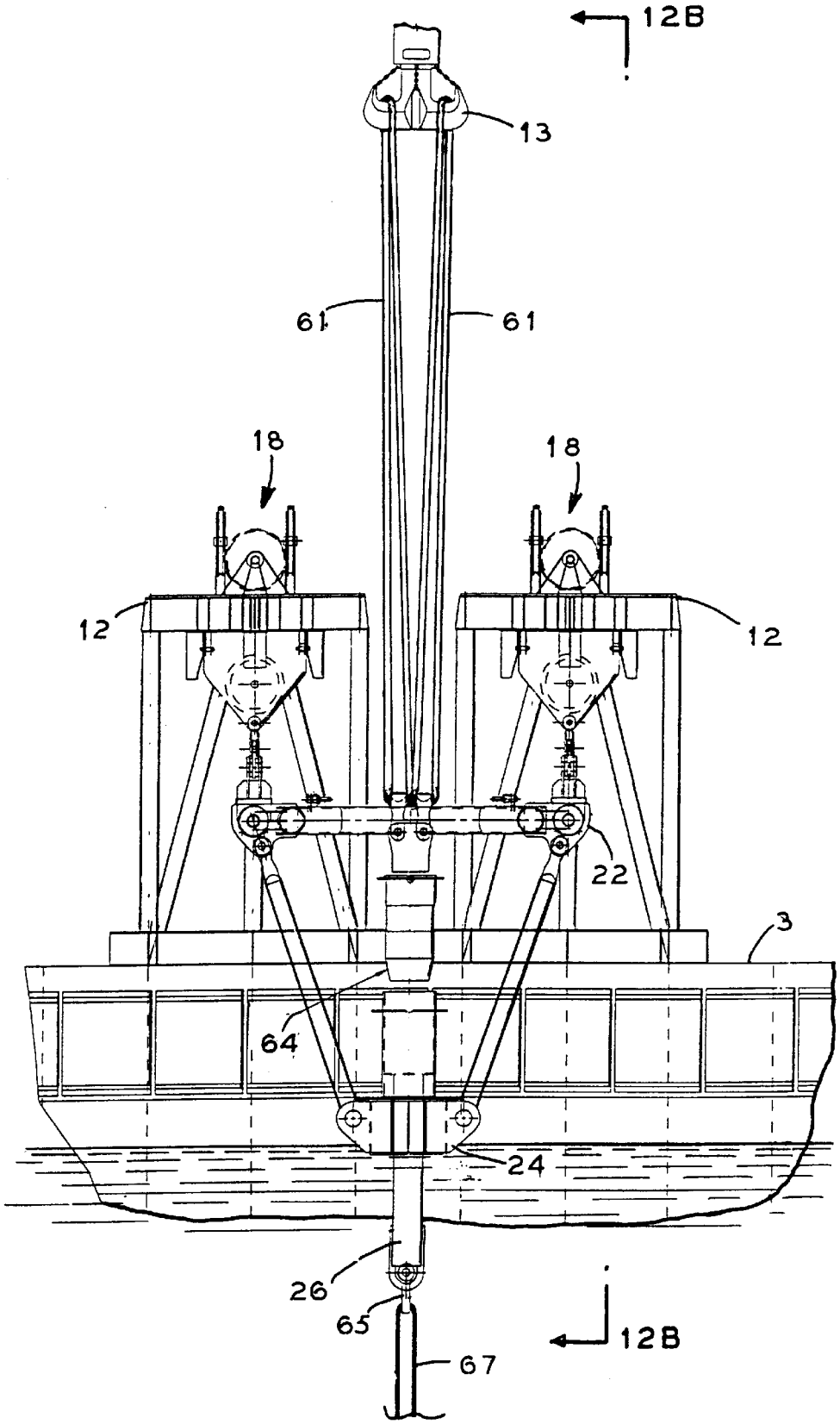
FIG. 12A illustrates the release of the crane components from the invention.
Figure 12B:
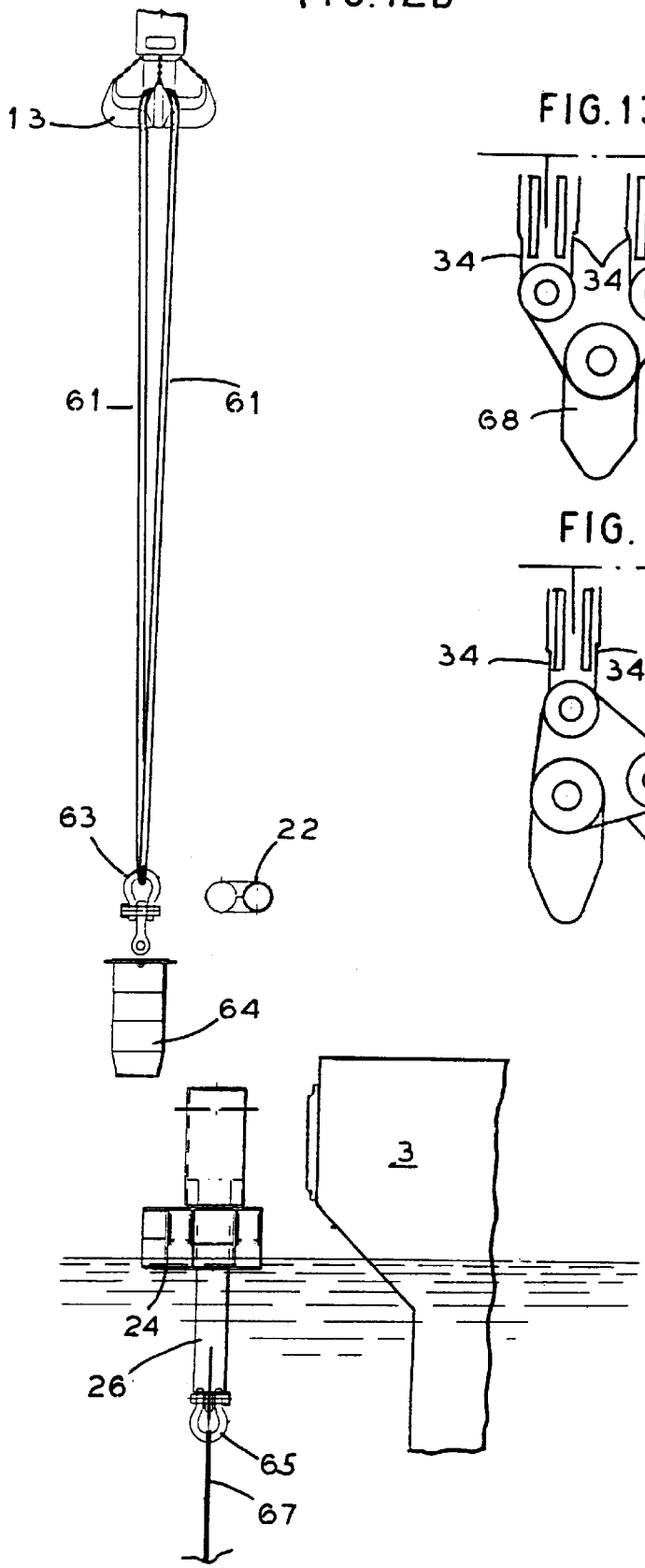
FIG. 12B is a view taken along lines 12B—12B in FIG. 12A.

As seen in FIG. 12A and 12B, once the load has been transferred, the crane 1 is removed from the lowering operation simply by releasing the crane internal elevator 64 from the lowering tool 26. The lowering tool 26 is adapted at the upper end to receive the crane internal elevator 64. The crane internal elevator 64 locks in place in the lowering tool 26 in a manner known in the art. Thus, the load has been transferred from the crane to the lowering apparatus of the invention in a quick and safe manner while eliminating the need for rigging work which would normally be required. The lowering operation is then carried out as generally illustrated in FIG. 4 and described above relative to the use of the winches.

Figure 13:
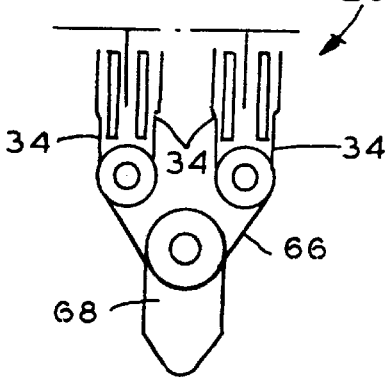
FIG. 13 illustrates a plate that allows the use of either two or four pulling lines with the invention.
Figure 14:
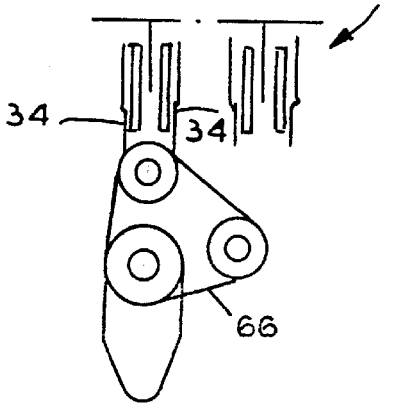
FIG. 14 illustrates the plate of FIG. 13 configured for the use of two pulling lines with the invention.

The drawings illustrate the invention in use with a configuration of four pulling lines 34 at each lower sheave block 20. However, depending upon the weight of the load and/or water depth, it may be desirable to perform lifting/lowering operations with a configuration of either two or four pulling lines. FIG. 13 illustrates a tri-plate 66 that allows either configuration to be used without the necessity to change to a different plate at the lower sheave block 20 or re-reeve the apparatus. In FIG. 13, the tri-plate 66 is attached to the lower block 20 at each sheave to provide a four line configuration. As seen in FIG. 14, one side of the plate 66 may be detached from a sheave by simply removing the pin(s) by hydraulic means without the need for rigger personnel. This allows the plate 66 to rotate downward under one sheave for a two line configuration. The shackle 68 rotates into position for attachment of lines to support the load. With a two line configuration, a load can be moved twice the distance and speed of a four line configuration. However, a two line configuration is only capable of handling one half the weight of a four line configuration.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. On a barge having a crane, a deep water lowering apparatus, comprising:

a. two davit structures mounted on the barge so as to be parallel to each other;

b. an upper sheave block mounted on each davit structure;

c. a lower sheave block suspended from each davit structure;

d. a traction winch aligned with each davit structure;

e. a storage winch aligned with each davit structure;

f. an equalizer beam mounted between said davit structures, said equalizer beam having two sheaves at the end of said equalizer beam adjacent the davit structures and one sheave at the end of said equalizer beam adjacent said storage winches;

g. a pendant line reeved around the one sheave on said equalizer beam;

h. a pulling line wound on each storage winch and reeved around said traction winches and said upper and lower sheave blocks, one of the two sheaves on said equalizer beam, with the end of each pulling line attached to one end of said pendant line;

i. a spreader bar attached to said lower sheave block;

j. an adaptor box attached to said spreader bar; and k. a lowering tool adapted to be received in said adaptor box and transfer a load directly to said adaptor box.

2. The apparatus of claim 1, wherein said spreader bar is provided with a dog leg center section.

3. The apparatus of claim 1, wherein said adaptor box is provided with a U-shaped opening for receiving said lowering tool.

4. The apparatus of claim 1, wherein the entire apparatus is mounted on a skid so as to be portable.

* * * * *